US007478776B2

(12) United States Patent
Salentine et al.

(10) Patent No.: US 7,478,776 B2
(45) **Date of Patent: *Jan. 20, 2009**

(54) ROTATABLE RETRACTING APPARATUS

(75) Inventors: John A. Salentine, Santa Barbara, CA (US); Kenneth S. Collin, Jr., Carpinteria, CA (US)

(73) Assignee: Hammerhead Industries, Inc., Ventura, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/270,905

(22) Filed: Nov. 10, 2005

(65) Prior Publication Data

US 2006/0054729 A1 Mar. 16, 2006

Related U.S. Application Data

(62) Division of application No. 10/461,084, filed on Jun. 12, 2003, now Pat. No. 6,966,519.

(60) Provisional application No. 60/388,462, filed on Jun. 13, 2002.

(51) Int. Cl.
*B65H 75/48* (2006.01)

(52) U.S. Cl. ..... 242/379; 242/379.2; 224/162; 224/197; 224/269; 224/666; 224/930

(58) Field of Classification Search ..... 242/379, 242/379.2, 399, 399.2, 588.1; 224/197, 269, 224/666, 667, 668, 669, 930, 162
See application file for complete search history.

(56) References Cited

U.S. PATENT DOCUMENTS

| | | | | | |
|---|---|---|---|---|---|
| 1,204,011 | A | * | 11/1916 | Greene | 242/341 |
| 3,381,916 | A | * | 5/1968 | Edgell | 242/381.2 |
| 5,938,137 | A | | 8/1999 | Poulson | 242/379.2 |
| 6,290,158 | B1 | | 9/2001 | Huang | 242/379 |

* cited by examiner

*Primary Examiner*—Evan H Langdon
(74) *Attorney, Agent, or Firm*—Koppel, Patrick, Heybl & Dawson

(57) ABSTRACT

A retracting tether apparatus is disclosed comprising a retractor housing having a locking post on its outside surface. The apparatus also includes an attachment mechanism, such as a belt clip, for attaching to a body and a retaining section, the attachment mechanism being integral to the retaining section. The retaining section has a retaining section hole sized to mate with the locking post and the locking post has a mechanism for holding the post in the retaining section hole. The inside surface of the retaining section hole rides on an outside surface of the locking post to provide for smooth rotation of the retractor housing in relation to the retaining section.

16 Claims, 8 Drawing Sheets

ROTATABLE RETRACTING APPARATUS

This is a divisional application and claims the benefit of patent application Ser. No. 10/461,084 filed on Jun. 12, 2003, now U.S. Pat. No. 6,966,519 which claims the benefit of provisional application No. 60/388,462 to Salentine et al. filed on Jun. 13, 2002.

BACKGROUND OF THE INVENTION

1. Field of the Invention

Present invention relates to retracting tethers and more particularly to a retracting tether apparatus mounted to a user's belt, pants, pocket, strap or purse, and arranged to be 360 degrees rotatable about its mounting point.

2. Description of the Related Art

Retractable tethering devices have been developed that can be attached to a person through use of common attachment mechanisms such as snaps, clips, Velcro straps, pin mounting systems, bracket mounting devices and belt clipping devices. Conventional belt clipping and bracketing systems are desirable for some applications in that they are easy to mount to an article of clothing that does not have means for attaching a snap, Velcro or pinning attachment. A belt clipping system also provides an attachment means that reduces the overall hanging length of the device and minimizes its movement during activities.

One disadvantage of most conventional retractable tethering devices ("tethering devices") using a belt clipping system is that when the retracting tether is mounted, it is generally in a fixed orientation in relation to its mounting point. Many different devices can be attached to the retracting tether's cable, such as keys, cell phones, pagers and PDAs, and when the device is in use the cable is extended from the retracting tether against a spring force. Because of its fixed orientation, the tethering device does not change its orientation to compensate for the cable being retracted at different angles. For example, keys can be attached to the cable of conventional tethering devices and the cable can be extended at different angles depending on the heights of the. However, most conventional retracting tethers do not rotate in relation to the clipping (mounting) point so regardless of height that the keys are being used, the housing hole remains in a fixed orientation. This causes excessive resistance and cable flexing or fatigue which can result in reduced overall life of the product.

U.S. Pat. No. 6,290,158 to Huang, discloses a tethering device for mounting on a user and having a housing assembled from an upper lid and a bottom lid. A male upper cover and a female lower cover are provided in the housing to form a reel axle for a coil spring and an extendable/retractable cable. One end of the cable is exposed to the exterior of the housing and a stop prevents the cable from fully retracting into the housing. A rivet sleeve is extended through aligned central holes in the bottom lid, the reel and the lining sleeve and is rivet fastened with its end extended through the lining sleeve. A reel axle is formed by the male upper cover, the female lower cover, and the lining sleeve, which are serially and tightly connected.

Huang claims that the tethering device can be smoothly rotated 360 degrees around the central reel axis. However, as illustrated in the figures of Huang, the belt clip is mounted by a mounting immediately adjacent to and in contact with the housing. This arrangement will likely result in a resistance between the belt clip, mounting bolt and housing and if the components are made of metal, this arrangement results in metal to metal wear. Further, any side torque on the housing could result in a torque on the belt clip causing the mating surfaces to bend, which can destroy the device's rotational capability. Further, rotational axis of the device is provided internal to the housing, which can cause complication in the design and operation of the housings internal spring arrangement.

U.S. Pat. No. 5,938,137 to Poulson discloses a retractable tethering device that is attached to a user's belt with its cable clipped to the rear surface of a cellular telephone case to prevent the phone from falling in the event it is accidentally dropped. The device includes a housing that swivels on its belt connection. The cable includes a strong cord wound on a spring biased spool within a housing which is pivotally connected to a spring steel belt clip. The belt clip is attached to near the center of the device's housing to the central shaft that passes through the housing with the preferred central shaft being a flat head screw journalled within a bushing sleeve spanning the side with the housing so that the housing spins around its axis.

Although it is unclear how this arrangement actually works, it appears to suffer from the same disadvantages as Huang. The bushing sleeve spans the interior of the housing such that is can interfere with the operation of the internal spring. Poulson does not disclose how the rotation riding surfaces are arranged but it likely has metal on metal moving parts that would also likely suffer from the resistance of adjacent moving metal surfaces and the resulting wear.

SUMMARY OF THE INVENTION

The present invention seeks to provide a tethering device that is rugged, easy to manufacture and assemble, and provides smooth rotation between the retractor housing and the attachment mechanism. One embodiment of a rotation device according to the present invention that can be used with a retractor, comprises a base having a locking post, the base being mounted to a first body. An attachment mechanism is included for attaching to a second body and a retaining section is also included, the attachment mechanism integral to the retaining section. The retaining section has a retaining section hole sized to mate with the locking post and the locking post has a mechanism for holding the post in the retaining section hole. The inside surface of the retaining section hole rides on the outside surface of the locking post to provide for smooth rotation of the retaining section in relation to the base.

An embodiment of a retracting tether apparatus according to the present invention comprises a retractor housing having a locking post on its outside surface. It also includes an attachment mechanism for attaching to a body and a retaining section, the attachment mechanism being integral to the retaining section. The retaining section has a retaining section hole sized to mate with the locking post and the locking post has a mechanism for holding the post in the retaining section hole. The inside surface of the retaining section hole rides on an outside surface of the locking post to provide for smooth rotation of the retractor housing in relation to the retaining section.

The attachment mechanism in each of the embodiments can comprise a belt clip that can be securely attached to a 'belt, pants, pocket, strap or purse. The retractor can rotate freely about the attachment mechanism through a full 360-degree rotational motion. This reduces the wear on the cable when the device attached to the cable not in use, and also when the cable is extracted during use of the device.

These and other further features and advantages of the invention will be apparent to those skilled in the art from the following detailed description, taken together with the accompanying drawings, in which:

DETAILED DESCRIPTION OF THE INVENTION

Figure 1:
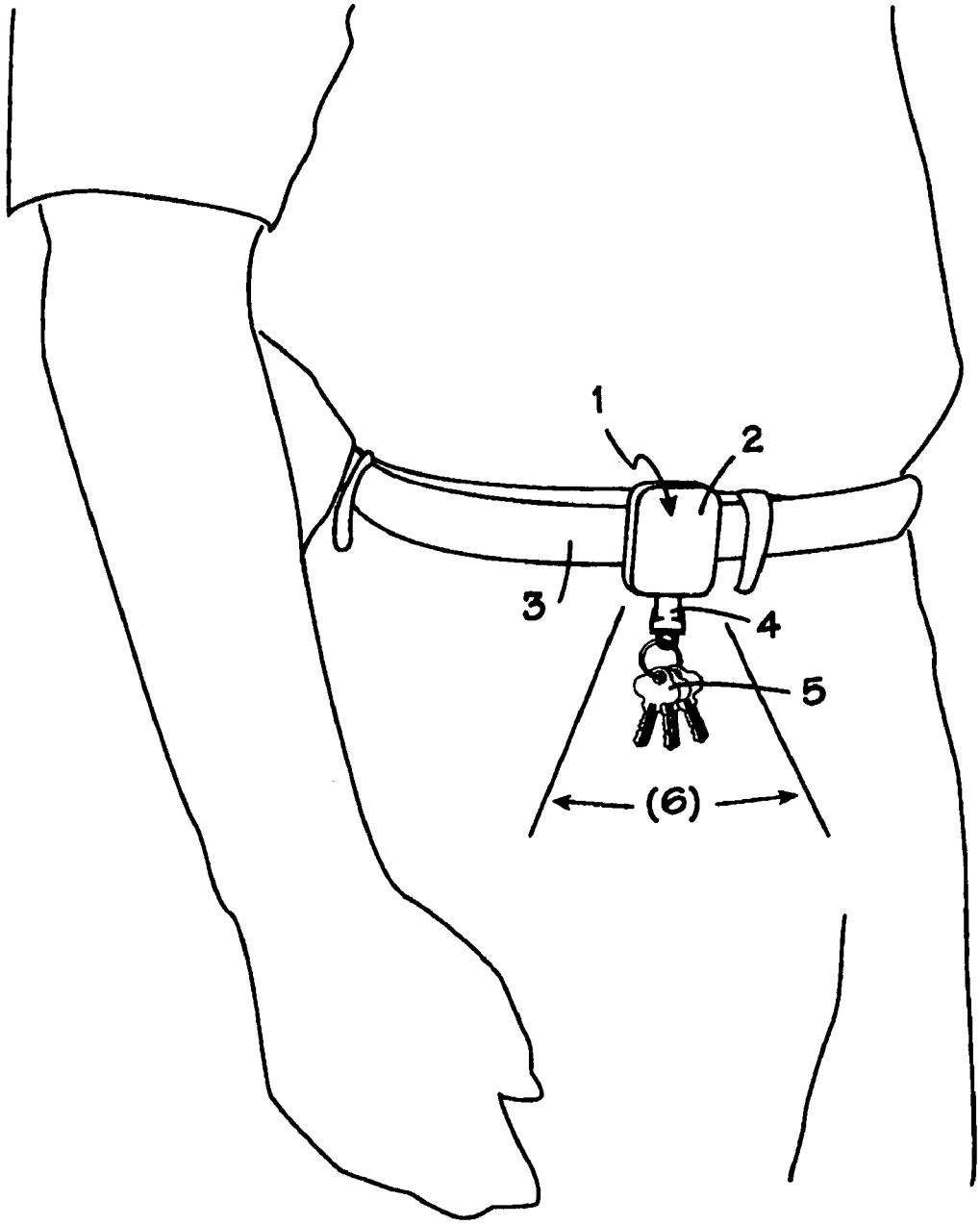
FIG. 1 shows a perspective view of one embodiment of a tethering device according to the present invention, with a device attached to the apparatus' cable.

FIG. 1 shows one embodiment of a tethering device 1 according to the present invention, which generally comprises a retractor 2 and rotating attachment mechanism that is further described below and shown in FIGS. 3 and 4. The attachment mechanism can attach to the user's belt, pants, pocket, strap or purse, with the mechanism shown attached to the user's belt 3. The apparatus 1 can utilize many different attachment mechanisms and many different retractors.

According to the present invention, the retractor 2 is capable of rotating 360 degrees about its mounting point, in a plane parallel to the attachment mechanism's plane. The retractor 2 has an internal cable (shown in FIG. 2) that can be extended against the force of an internal spring. When the extending force is removed, the cable is retracted into the retractor under the spring force. The mechanism for extending and retracting the cable from the retractor 2 is known in the art and can involve a coil spring and reel arrangement as generally described in U.S. Pat. No. 5,697,572 to Salentine and Collin, assigned to the same assignee as the present application.

The cable has a stop 4 which has a larger diameter than the housing hole to prevent the cable from fully retracting into the housing. The stop can also comprise a disconnect mechanism that allows for a device attached to the cable to be easily disconnected. Different disconnect mechanisms can be used with the stop 4, with a suitable mechanism being a clip type. Other disconnect mechanisms can be used including, but not limited to, snaps, screws, ties, or Velcro.

In the embodiment shown, keys 5 are attached to the apparatus's cable, although many different devices can be attached including but not limited to cell phones, pagers and PDA's. Because the retractor 2 can rotate about its mounting point, the weight of the keys rotates the housing so that the keys are directed downward. Movement such as a walking can cause the keys 5 to swing back and forth or side to side and according to the invention, this movement can cause the retractor 2 to pivot about its mounting point through a range of motion 6. This reduces flexing and fatigue on the retractor's cable which can result in reduced overall life of the retractor 2.

Figure 2:
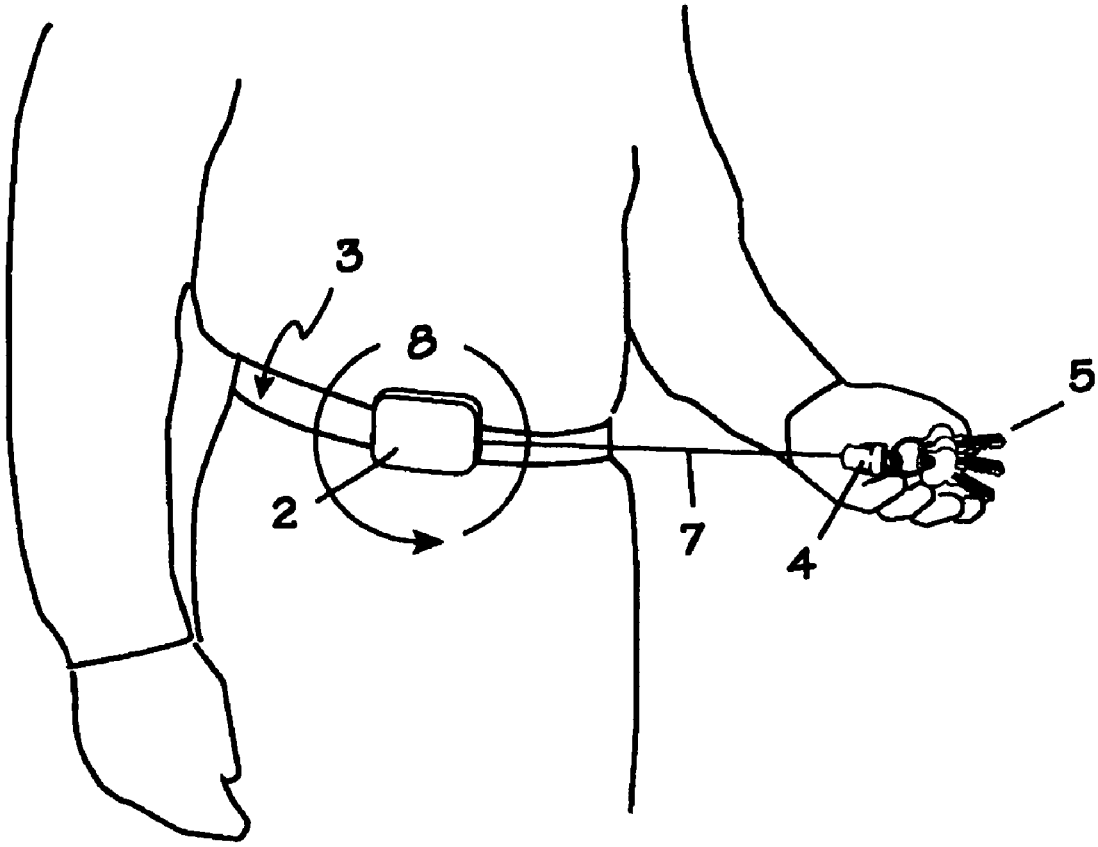
FIG. 2 shows the tethering device of FIG. 1, with the attached device in use.

FIG. 2 shows the retracting device 1 with the keys 5 in use and extended to a forward position. The force applied to the keys 5 as they are lifted and the cable 7 is extended from the retractor 2, causes the retractor 2 to rotate about its attachment point so that it is aligned with the extended cable 7. The retractor 2 can rotate through a 360-degree range of motion 8 so that it can be aligned with the cable 7 as it is extended in various directions. This further reduces flexing and fatigue on the retractor's cable which can result in reduced overall life of the retractor 2.

Figure 3:
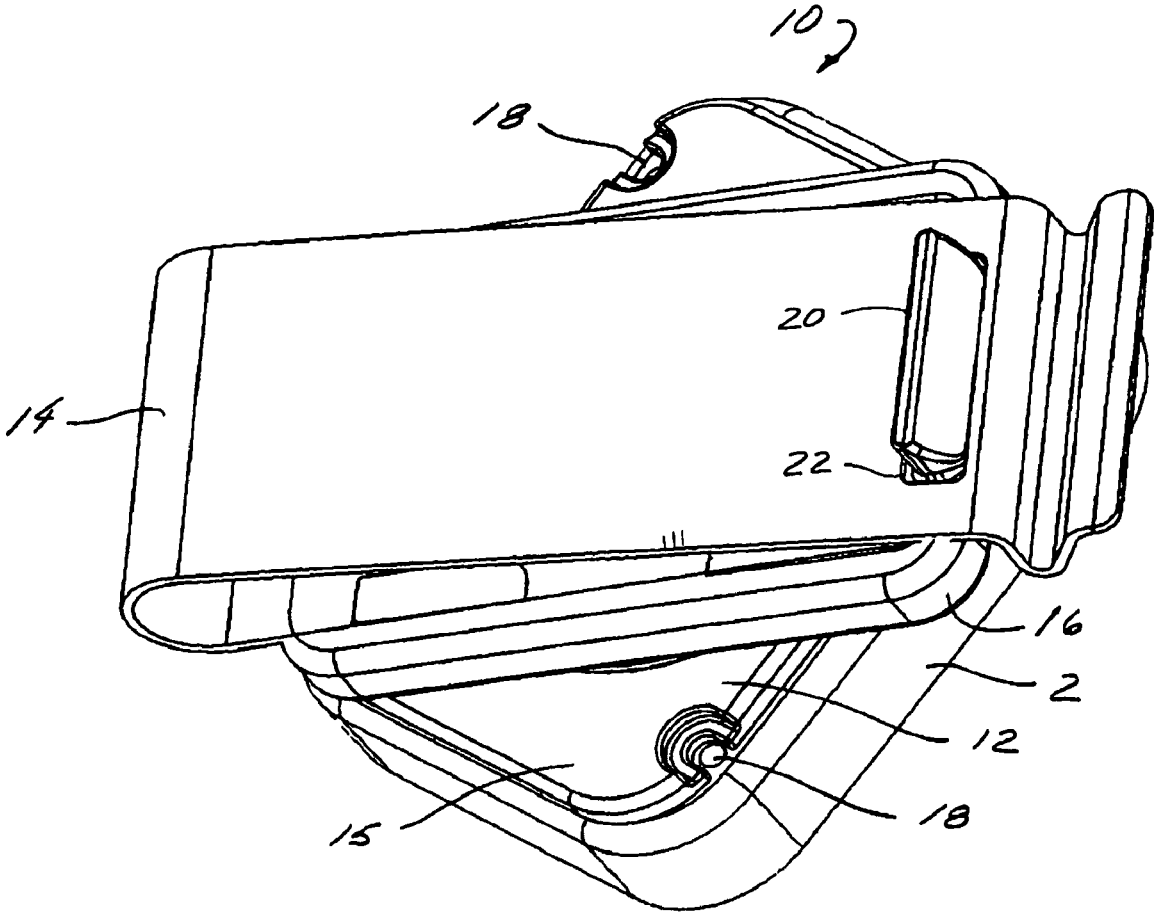
FIG. 3 is a perspective view of one embodiment of a tethering device rotation mechanism according to the present invention.
Figure 4:
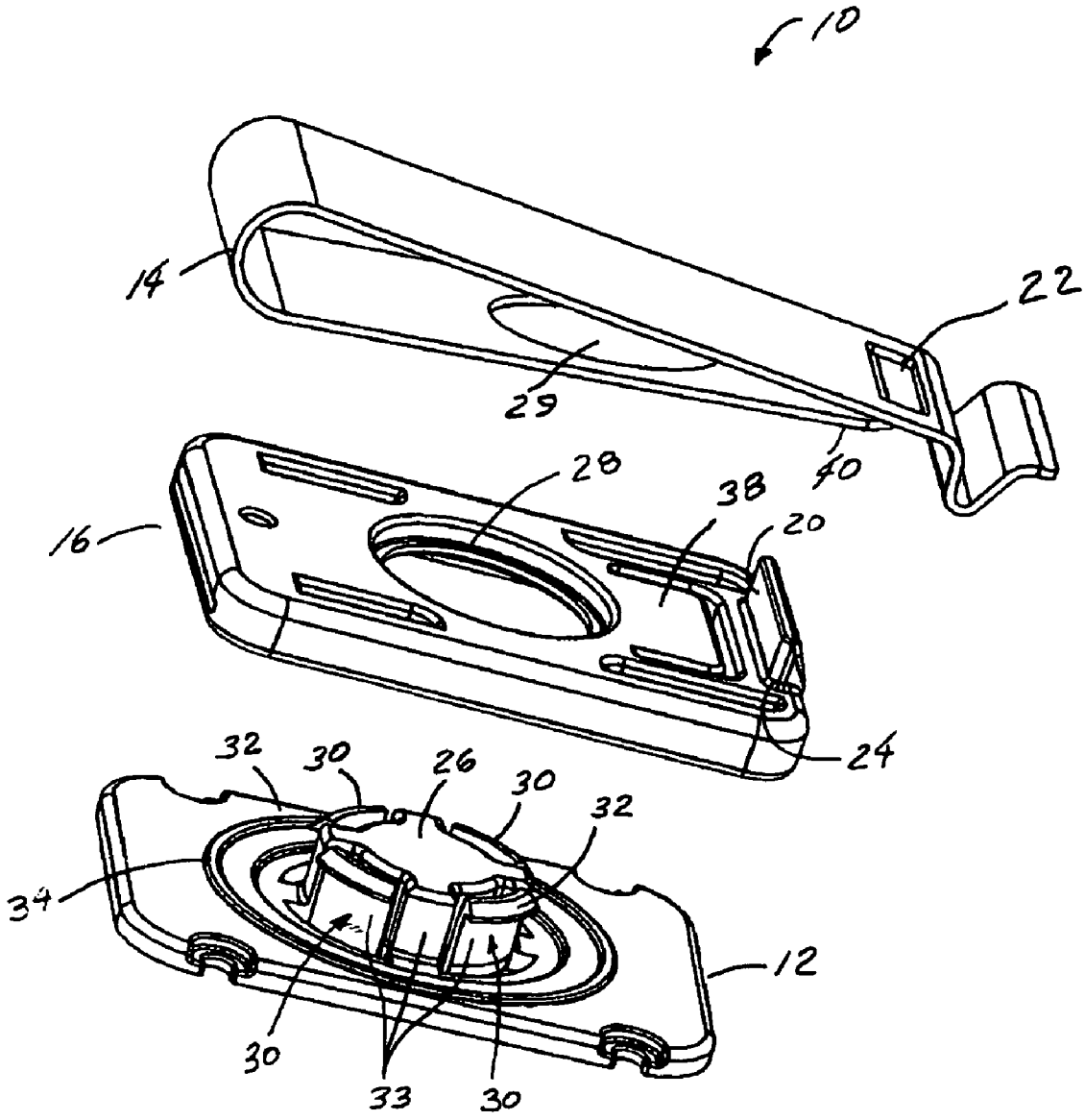
FIG. 4 is an exploded view of the mechanism shown in FIG. 3.

FIGS. 3 and 4 shows one embodiment of a rotation mechanism/device 10 according to the present invention, which can be attached to the back of a retractor such as retractor 2 shown in FIGS. 1 and 2. The mechanism 10 generally includes a base 12, a belt clip 14 and a retaining section 16. The base 12 can either be arranged so that it also serves as the back surface of the retractor or, as shown, it can be arranged so that it is mountable to the retractor. In both embodiments the base 12 includes a rectangular planar section 15 with a locking post 26 near the center. The locking post 26 is sized to fit through the retaining section hole 28 and the belt clip hole 29, and serves to hold the pieces of the mechanism 10 together while allowing smooth rotation of the mechanism is relation to the retractor.

The post 26 has circumferential tabs 30 that are fixed to the planar surface and can be flexible so that the top of each of the tabs 30 is compressible toward the post's longitudinal axis. Each tab 30 has a radial tab lip 32 and as the post 26 is inserted into the retaining section hole 28 the tabs compress as the lips 32 pass the inside surface of the hole 28. After the lips 32 pass through the hole, the tabs 30 expand to their neutral position, and the lips 32 hold the post 26 within the hole 28 while allowing the retaining section 16 to rotate around the post 26. The inside surface of the hole 28 primarily contacts the post's axial surface 33.

The planar section 15 further comprises a raised circular riding surface 34 arranged around the post 26. The retaining section 16 primarily contacts the base 12 on the top surface of the circular riding surface 34, which allows the retaining section 16 to more smoothly rotate around the post 26 and in relation to the base 12.

The base 12 is then mounted to a retractor 2 (shown in FIG. 3) by passing screws or rivets through the mounting slots 18, and into the retractor. Other attachment methods can also be used such as gluing.

The belt clip 14 is generally U-shaped and when the mechanism 10 is assembled, the retaining section 16 is arranged within the belt clip, between the legs of the U-shape, with the retaining section's hole 28 aligned with belt clip hole 29. Accordingly, when the post 26 passes into the retaining section hole 28 it first passes through the belt clip hole 29. The retaining section 16 also has a planar tab 38 that is arranged to mate with a first slot 40 in the belt clip 14. As the belt clip is mounted to the retaining section 16, the planar tab 38 mates with the first slot 40. The belt clip 12 is held on mechanism 10 by the post 26 and mating of the planar tab 38 with the first slot 40.

The belt clip 12 fits over a belt with a portion of the belt held between the uncovered leg of the U-shape and the retaining section 16. The retaining section 16 also has a locking tange 20 to mate with a second lower slot 22 in the belt clip 14. After the belt is sandwiched between within the clip 14, the tange 20 mates with the first slot 22 to hold the belt within the mechanism 10. The tange 20 has a tang lip 24 and as the tange 20 is inserted into the slot 22, the tange (or tange lip) flexes. As the tange 20 passes through the slot 22, the tange flexes back so that the tange 20 is held within the slot 22 by the tange lip 24. This essentially locks the belt within the clip 14 until the tange 20 is flexed by the user to remove the tange 20 from the slot 22.

The base 12, clip 14 and retaining section 16 can be made of many different materials, with a preferred material for the base 12 and retaining section 16 being plastic. This allows for the surfaces of the base 12 that are in contact with the surfaces of the retaining section 16 to ride smoothly on one another, which in turn allows the retaining section 16 to rotate smoothly and easily in relation to the base 12. The clip 14 can also be made of many different materials with a preferred material being a metal.

Figure 5:
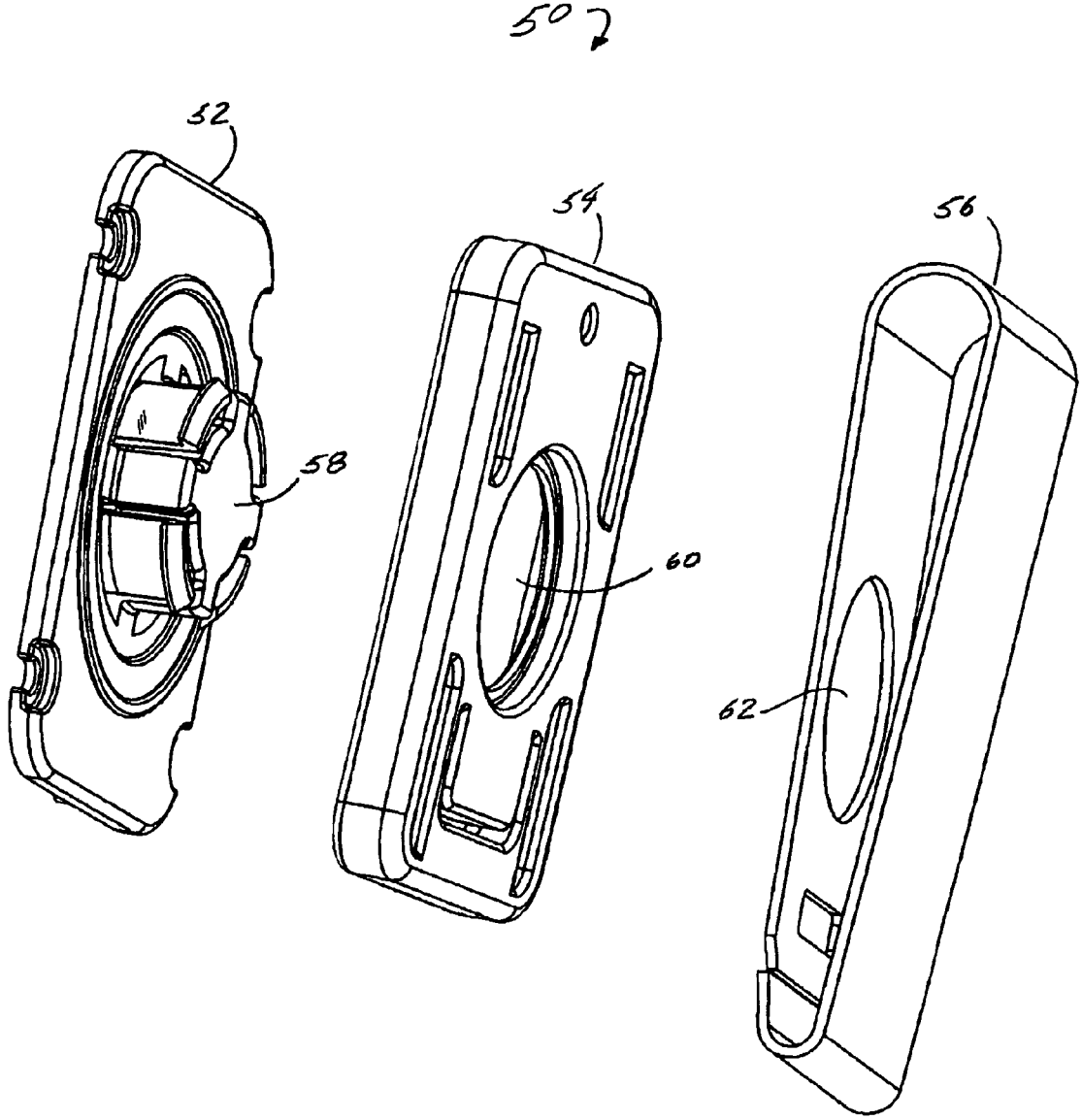
FIG. 5 is an exploded view of another embodiment of a tethering device rotation mechanism according to the present invention with a closed belt clip.

FIG. 5 shows another embodiment of a rotation mechanism 50 according to the present invention that is similar to the attachment mechanism 10, in FIGS. 3 and 4. It has a base 52, retaining section 54, and belt clip 56, with the base having a central post 58 that passes through the aligned retaining hole 60 and belt clip hole 62, to hold the retaining section 54 and belt clip 56 on the base 52. The belt clip 56 is mounted to the retaining section 54 such that they rotate around the post 58 as a unit. The belt clip 56, however, is not U-shaped but is enclosed and is mounted to a belt by sliding the belt into the enclosed clip. This arrangement provides a sturdy belt attachment that cannot be accidentally jarred from the belt.

Figure 6:
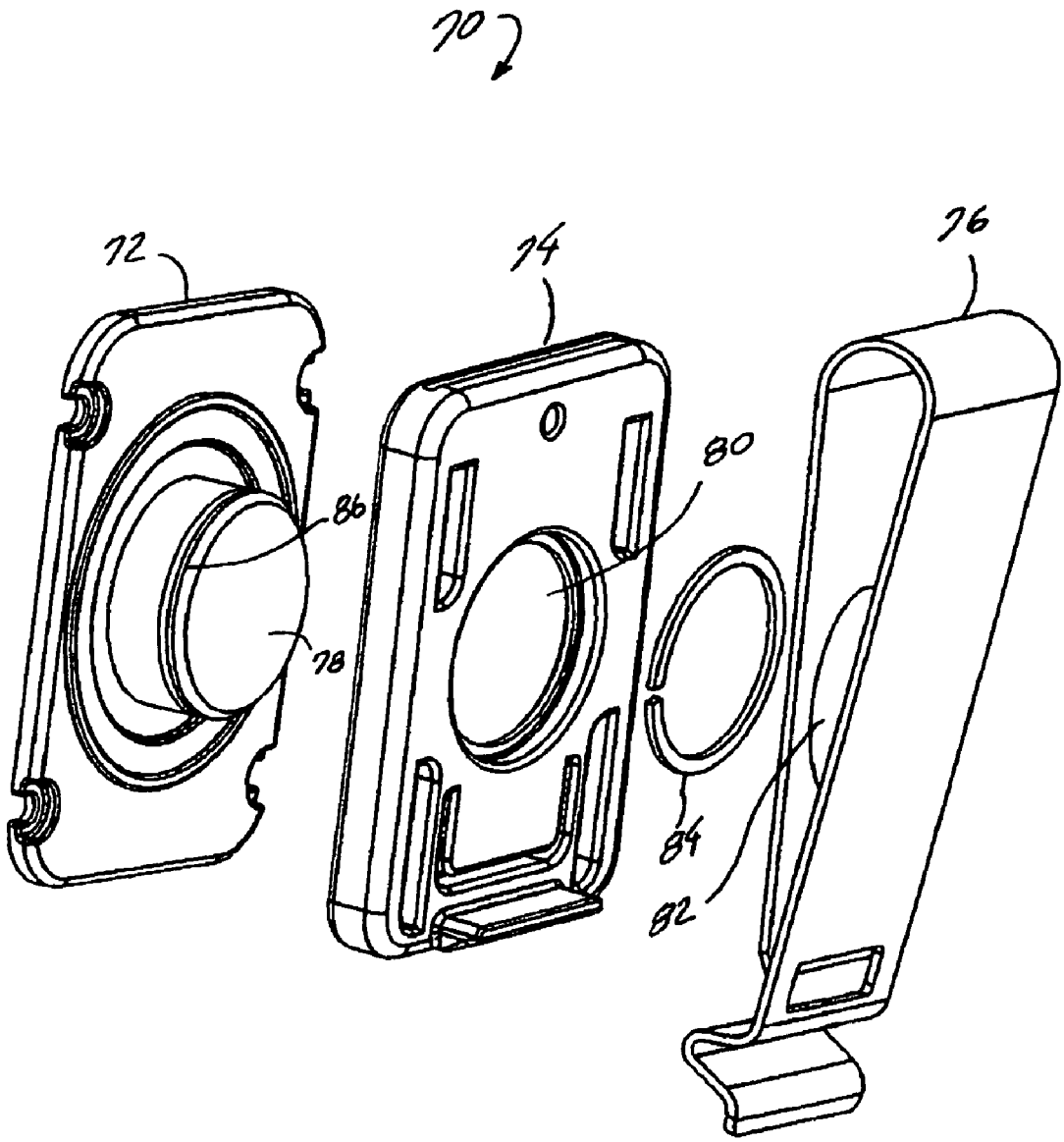
FIG. 6 is an exploded view of another embodiment of a tethering device rotation mechanism according to the present invention having a retaining ring assembly.

FIG. 6 shows another embodiment of a rotation mechanism 70 according to the present invention that is also similar to the mechanism 10 shown in FIGS. 3 and 4. It includes a base 72, retaining section 74, and U-shaped belt clip 76, although other belt clips and attachment mechanisms can be used. The base 72 has a central post 78 that passes through the aligned retaining section hole 80 and belt clip hole 82, but the post 78 does not have circumferential tabs as in the post 26 in FIGS. 3 and 4. Instead, the post 78 is held in the retaining section hole 80 by a retaining ring 84 that is mounted in a axial slot 86 in the post 78. The post 78 is passed through the aligned retaining section and belt clip holes 80, 82, and the retaining ring 84 is then mounted in slot 86. The retaining ring 84 has a larger diameter than the retaining section hole 80 to hold the retaining section 74 and belt clip 82 on the post 78.

Figure 7:
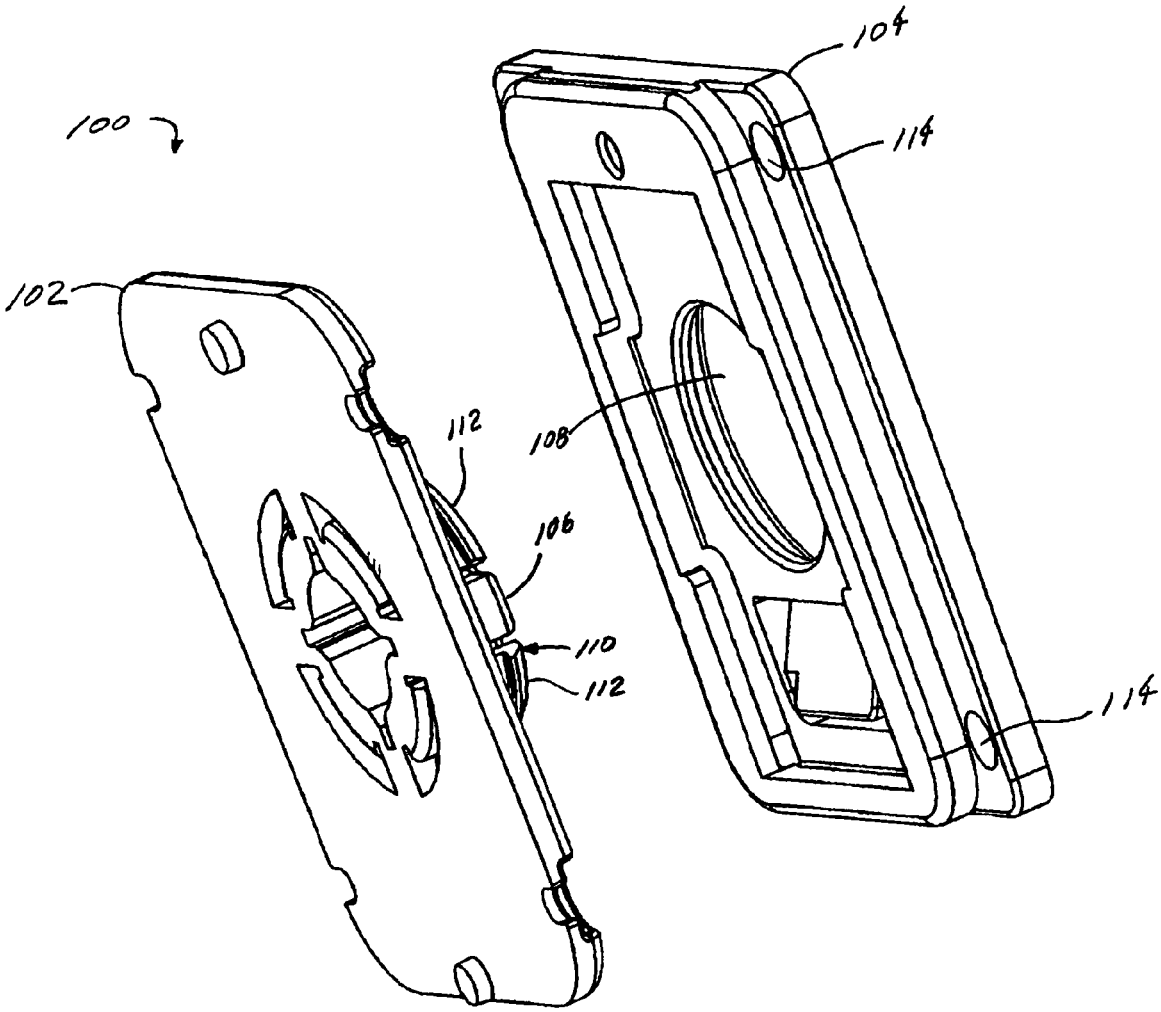
FIG. 7 is an exploded view an another embodiment of a tethering device rotation mechanism according to the present invention having a mounting plate.
Figure 8:
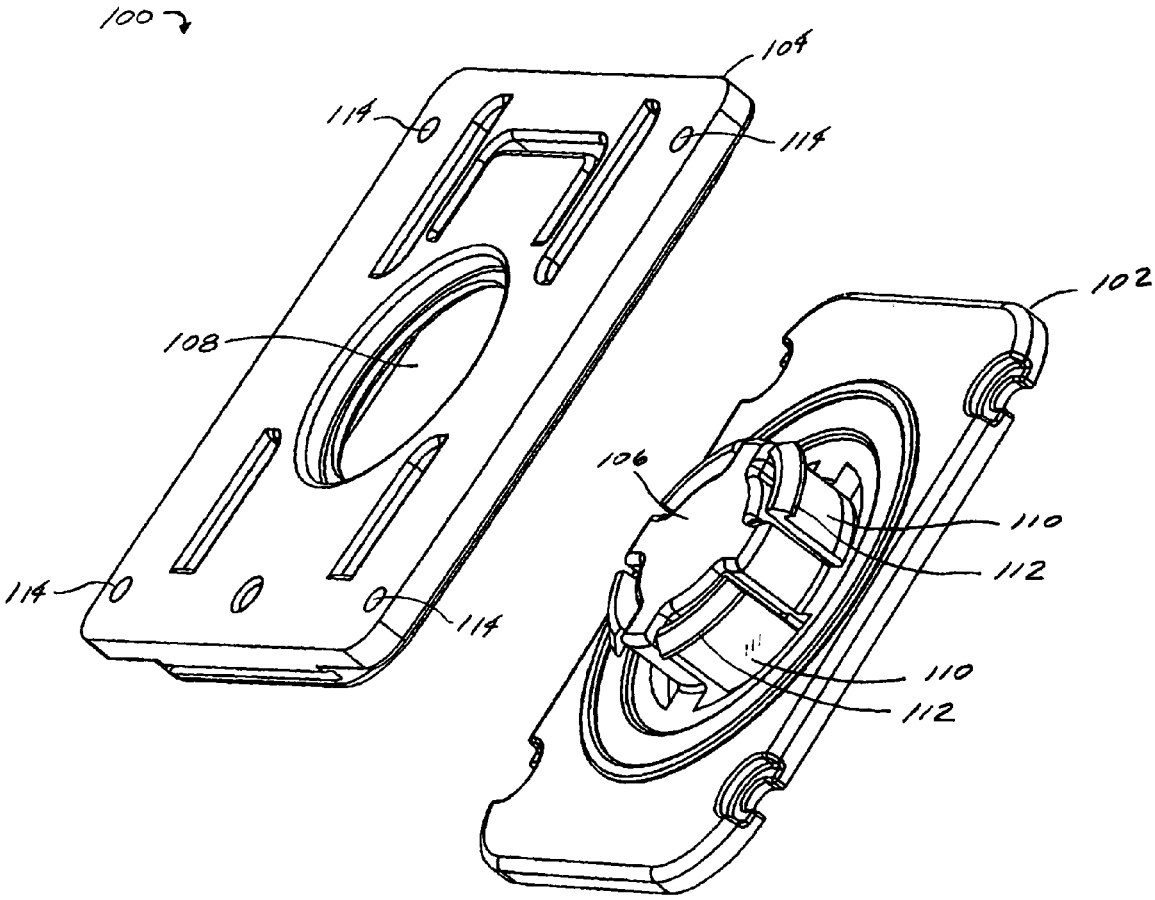
FIG. 8 is another exploded view of the tethering device shown in FIG. 7.

FIGS. 7 and 8 show still another embodiment of an a rotation mechanism 100 according to the present invention that is similar to the mechanism 10 shown in FIGS. 3 and 4. In includes a base 102, and a retaining section 104, with the base 102 having a central post 106 to mate with the retaining section hole 108. The post 106 has circumferential tabs 110, each of which has a tab lip 112 to hold the post in the retaining section hole 108. In mechanism 100, however, it does not have a belt clip. Instead, the retaining section 104 serves as a mounting plate that can be mounted to a body/housing by many different methods such as screwing, bolting, gluing or welding. The mechanism 100 has mounting holes 114 for screws or bolts to pass through to mount the mechanism 100. This embodiment can be used in many different applications, but is particularly applicable to applications wherein the tethering device is to be mounted to a fixed location.

The invention provides an improved tethering device for attaching to belts, pockets, purses, etc., which provides advantages over the prior art. One of the advantages is that the tethering device is allowed to pivot during movement of the user, thereby reducing the cable flexing a fatigue when the retracting device is in a stationary mode of operation. Also, the tethering device can pivot horizontally to the body up to 360 degrees when the cable is extended during use such as during the operation of opening a door with keys or raising a cell phone to the ear, thereby reducing the resistance of the device and more importantly reducing the amount of flex and therefore fatigue to the cable.

The present invention also provides for a tethering device having an attachment/rotation mechanism that does not impact or interfere with the internal workings of the retractor. The base 12, is either mounted to the back of the retainer or is part of one of the retainer surfaces, with the locking post 26 in either case extending out from the retainer. The retaining section 16 and belt clip 14, are then mounted on the post 26, resulting in a rotation mechanism external to the retractor. The arrangement allows the rotation mechanism to be used with many different types of retractors.

The large diameter of the post 26 provides for strength and stability in the rotation of the retractor and the large bearing/riding surface of the post provides for smooth rotation. The use of plastic for the retainer 16 and the post 26 provides for plastic (lubricous) mating surfaces that increase the life and minimize the wear of surfaces.

The present invention also provides a rotation mechanism that is easy to manufacture and assemble. The belt clip 14 and the retaining section 16 snap together and then snap onto the locking post 26 of the base 12. In different embodiments of the rotation mechanism according to the present invention, the belt clip 14 and the retaining section 12 can both be made of plastic and can be made as a single assembly. There is no need for additional screws or bolts to mount the belt clip.

The snap together design also allows for a non-destructive breakaway feature. In prior retractors, if sufficient lateral force is applied to the retractor housing, the belt clip will break away from the housing at its connection point, destroying the connection between the belt clip and housing. In the present application lateral force on the housing causes the locking post 26 to detach the retaining section hole 28 without being damaged. The housing can then be mounted back on the retaining section (and belt clip). In other embodiments of the invention, the locking post can have a destructive connection when the lateral force causes the post 26 to detach.

The design of the retractor also provides the interlocking feature between the belt clip and the retaining section in the form of the mating tange 20 and slot 22. This holds the retracting device on a belt and also provides a holding force with a mounted to fabric by sandwiching a piece of the material between the tange 22 and slot 22.

Although the present invention has been described in considerable detail with reference to certain preferred configurations thereof, other versions are possible. Therefore, the spirit and scope of the invention should not be limited to the embodiments described above.

We claim:

1. A rotation device, comprising:

a base having first and second opposing sides, said first side having a planar section with a locking post that protrudes from the center of said planar section, said base being mounted to a first body with said second side of said base facing said first body such that said locking post extends away from said first body and does not pass into said first body;

an attachment mechanism for attaching to a second body;

a retaining section, said attachment mechanism integral to said retaining section, said retaining section having a retaining section hole sized to mate with said locking post, said locking post having a mechanism for holding said post in said retaining section hole, the inside surface of said retaining section hole riding on the outside surface of said locking post to provide for smooth rotation of said retaining section in relation to said base to allow said first body to rotate about said attachment mechanism without said locking post interfering with internal portions of said first body.

2. The device of claim 1, wherein said attachment mechanism comprises a U-shaped belt clip mounted to said retaining section.

3. The device of claim 1, wherein said base further comprises a planar section with said locking post mounted to the center of said planar section.

4. The device of claim 3, wherein said planar section further comprises a plurality of mounting slots and a plurality of screws, each of said screws arranged to turn into said body through a respective one of said slots to mount said base to said first body.

5. The device of claim 3, wherein said planar section is mounted to said first body by one of the methods from the group consisting of gluing, welding and molding.

6. The device of claim 3, wherein said planar section further comprises a raised riding surface on the surface of said planar section adjacent to said retaining section, said riding surface contacting said retaining section and allowing for smooth rotation of said retaining section in relation to said base.

7. The device of claim 1, wherein said locking post comprises a plurality of circumferential tabs, each of which is flexible toward the post's longitudinal axis.

8. The device of claim 7, wherein said mechanism for holding said post in said retaining section hole comprising a plurality of radial tab lips, each of which is integral to a respective circumferential tab and arranged to hold said retaining section on said post.

9. The device of claim 1, wherein said post can be detached from within said retaining section hole by a lateral force on said post.

10. A rotation device, comprising:

a base having a locking post that protrudes from an external surface of said base, said base being integral to a first body that is disposed opposite said external surface of said base, said post extending from said base and away from said first body;

a retaining section having a mechanism for mounting to a second body and having a retaining section hole sized to mate with said locking post, said locking post having a mechanism for holding said post in said retaining section hole, the inside surface of said retaining section hole riding on the outside surface of said locking post to provide for smooth rotation of said retaining section in relation to said base, to allow said first body to rotate about said attachment mechanism without said post passing into said first body.

11. The device of claim 10, wherein said base further comprises a planar section with said locking post mounted to the center of said planar section, said planar section being mountable to said first body.

12. The device of claim 10, wherein said planar section further comprises a plurality of mounting slots and a plurality of screws, each of said screws arranged to turn into said body through a respective one of said slots to mount said base to said first body.

13. The device of claim 10, wherein said planar section further comprises a raised riding surface on the surface of said planar section adjacent to said retaining section, said riding surface contacting said retaining section and allowing for smooth rotation of said retaining section in relation to said base.

14. The device of claim 10, wherein said locking post comprises a plurality of circumferential tabs, each of which is flexible toward the post's longitudinal axis.

15. The device of claim 14, wherein said mechanism for holding said post in said retaining section hole comprising a plurality of radial tab lips, each of which is integral to a respective circumferential tab and arranged to hold said retaining section on said post.

16. The device of claim 10, wherein said post can be detached from within said retaining section hole by a lateral force on said post.

* * * * *